US009056321B2

(12) United States Patent
Nakayama et al.

(10) Patent No.: US 9,056,321 B2
(45) Date of Patent: Jun. 16, 2015

(54) SPRAY GUN, SPRAY APPLICATION APPARATUS, AND SPRAY APPLICATION METHOD

(75) Inventors: Toshiaki Nakayama, Funabashi (JP); Akihiro Sugiyama, Tokyo (JP); Noriyoshi Yano, Zushi (JP)

(73) Assignee: Dyflex Corporation, Tokyo (JP)

( * ) Notice: Subject to any disclaimer, the term of this patent is extended or adjusted under 35 U.S.C. 154(b) by 333 days.

(21) Appl. No.: 13/576,812

(22) PCT Filed: Jun. 4, 2010
(Under 37 CFR 1.47)

(86) PCT No.: PCT/JP2010/003743
§ 371 (c)(1),
(2), (4) Date: Mar. 12, 2013

(87) PCT Pub. No.: WO2011/096022
PCT Pub. Date: Aug. 11, 2011

(65) Prior Publication Data

US 2013/0224389 A1 Aug. 29, 2013

(30) Foreign Application Priority Data

Feb. 3, 2010 (JP) ..... 2010-022290

(51) Int. Cl.
*B05B 7/04* (2006.01)
*B05B 7/24* (2006.01)

(52) U.S. Cl.
CPC ..... *B05B 7/0416* (2013.01); *B05B 7/0483* (2013.01); *B05B 7/0408* (2013.01); *B05B 7/2497* (2013.01)

(58) Field of Classification Search
CPC ..... B05B 7/0483
USPC ..... 427/421.1
See application file for complete search history.

(56) References Cited

U.S. PATENT DOCUMENTS 2,356,865 A 8/1944 Mason
2008/0305420 A1 12/2008 Kinoshita et al.

FOREIGN PATENT DOCUMENTS

DE 102006001319 A1 7/2007
GB 2027354 A 2/1980
JP 62095160 A 5/1987

(Continued)

OTHER PUBLICATIONS

Japanese Patent Office, Notice of Allowance issued in corresponding Japanese Patent Application No. 2010-022290 and English-language translation mailed Jul. 29, 2014 (6 pages).

(Continued)

*Primary Examiner* — Nathan T Leong
(74) *Attorney, Agent, or Firm* — Wood, Herron & Evans, LLP

(57) ABSTRACT

The spray gun is provided with a nozzle section which mixes gas into raw material liquid and also ejects the raw material liquid. The internal space of the nozzle section has an introduction path into which the raw material liquid is introduced, an open portion in which a flow path is enlarged more than the introduction path, thereby ejecting the raw material liquid in a fine particle form, a reduced diameter portion in which a flow path is made narrower than the open portion, thereby re-aggregating the raw material liquid in a fine particle form, and an ejection orifice portion which ejects the raw material liquid to the outside. In the nozzle section, a gas introduction hole which introduces gas into a base-end-side portion of the open portion is formed.

6 Claims, 5 Drawing Sheets

(56) References Cited

FOREIGN PATENT DOCUMENTS

| | | | |
|---|---|---|---|
| JP | 62-170158 | | 10/1987 |
| JP | 2-53149 | | 4/1990 |
| JP | 7-10358 | | 2/1995 |
| JP | 2001-321701 | | 11/2001 |
| JP | 2007061810 | A | 3/2007 |
| RU | 2367152 | C1 | 9/2009 |
| WO | 2005005055 | A1 | 1/2005 |
| WO | 2011096022 | A1 | 8/2011 |

OTHER PUBLICATIONS

Search Report issued in International Patent Application No. PCT/JP2010/003743; Oct. 12, 2010; 4 pages; Japanese Patent Office.

European Patent Office, extended European Search Report issued in corresponding European Patent Application No. 10845160.0 (Oct. 15, 2014) (6 pages).

State Intellectual Property Office of the People's Republic of China, First Office Action issued in corresponding Chinese Patent Application No. 201080065189.2 and English-language translation issued Oct. 30, 2014 (17 pages).

SPRAY GUN, SPRAY APPLICATION APPARATUS, AND SPRAY APPLICATION METHOD

TECHNICAL FIELD

The present invention relates to a spray gun for forming a resin layer such as a waterproof layer having functions as a substrate-behavior buffer layer and a substrate layer, a spray application apparatus using the spray gun, and a spray application method using the spray gun. In the spray gun, the spray application apparatus, and the spray application method, mixture-cure type or moisture-cure type resin is used.

Priority is claimed on Japanese Patent Application No. 2010-022290 filed with the Japan Patent Office on Feb. 3, 2010, the content of which is incorporated herein by reference.

BACKGROUND ART

In the waterproof application of a rooftop, a veranda, a corridor, or the like of an architectural construction, or the covering application of a structure in which an impact buffering function is required (such as a play equipment or the like), two-agent mixture-cure type resin or moisture-cure type resin, such as polyurethane, is widely used.

At the time of the application, with a spray gun, raw material liquid is sprayed on an application object, thereby forming a resin layer.

For the resin layer, a function (a substrate treatment function) to adjust to concavity/convexity, unevenness, a difference in level, gaps or the like of a substrate of the application object, is required. Also, it is preferable to have a high buffering function against behavior (movement) such as expansion, contraction, or deformation of the substrate. Further, in order to achieve a longer service life of a structure, reducing weight is also required for a resin layer which is formed on the structure.

In recent years, to deal with these demands, using a low-density resin layer which is made of fast-cure type urethane resin has been studied.

In order to form the low-density resin layer, for example, by using a spray gun having a structure in which gas is introduced, spray application is performed while gas is supplied into a nozzle section of the spray gun.

In the spray gun, in order to prevent the inflow (backflow) of a raw material liquid to a gas introduction path, transport pressure of the raw material liquid is set to be relatively low and supply pressure of the gas is set to be relatively high.

Since transport pressure of the raw material liquid is low and mixing is prone to be insufficient, a spray gun with a built-in agitation device which agitates the raw material liquid is proposed (refer to PTL 1, for example).

CITATION LIST

Patent Literature

[PTL 1] Japanese Unexamined Patent Application, First Publication No. 2001-321701

DISCLOSURE OF INVENTION

Problems to be Solved by the Invention

In the above-mentioned spray gun, volume to be splayed is lesser, since transport pressure of the raw material liquid is low, resulting longer application time. Also, the raw material liquid is scattered excessively at the time of the spray application, since gas supply pressure is high, resulting placement of resin at unintended locations. Further, concavity/convexity is easily formed on the surface of the low-density resin layer.

In addition, the raw material liquid tends to remain inside of the spray gun, since the spray gun has a built-in agitation device and a complicated flow path structure. Consequently, each time the discharge of the raw material liquid is stopped, it is necessary to clean the inside with an organic solvent, making application more labor intensive. Maintaining the above-mentioned spray gun is also demanding, since the number of component parts is high and its structure is complicated.

The present invention has been made in view of the above-mentioned circumstances and has an object to provide a spray gun with light weight, being able to form a low density resin layer in a short time. The low density resin layer formed by the spray gun of the present invention, has low concavity/convexity. It is also excellent in a substrate treatment function and a substrate buffering function. Scattering of resin is also suppressed in the spray gun of the present invention. As a result, a spray gun allowing easier application without high maintenance, a spray application apparatus using the spray gun, and a spray application method with the spray application apparatus are provided.

Means for Solving the Problem

A spray gun according to the present invention is a spray gun which forms a resin layer made of low-density resin by spraying raw material liquid along with gas, including: a main body section into which the raw material liquid is introduced; and a nozzle section provided at a leading end of the main body section for mixing gas into the raw material liquid and ejecting the raw material liquid, wherein an internal space of the nozzle section includes an introduction path into which the raw material liquid is introduced, an open portion in which a flow path is enlarged more than the introduction path for spouting the raw material liquid in a fine particle form, a reduced diameter portion in which a flow path is made narrower than the open portion for re-aggregating the raw material liquid in a fine particle form, and an ejection orifice portion which ejects the raw material liquid to the outside, and a gas introduction hole which introduces the gas into a base-end-side portion of the open portion is formed in the nozzle section.

It is preferable that the open portion has an enlarged diameter portion in which the diameter thereof is gradually enlarged toward a leading end direction from an outlet of the introduction path, and the gas introduction hole introduces gas into the enlarged diameter portion.

It is preferable that a diameter of the reduced diameter portion is gradually reduced toward the leading end direction from the open portion.

It is preferable that the nozzle section further includes a nozzle section main body having the internal space, and a leading end tube portion positioned at the leading end of the nozzle section main body, and an inner diameter of the leading end tube portion is larger than the inner diameter of the ejection orifice portion, and the leading end tube portion is further extended toward the leading end direction than the leading end of the nozzle section main body.

It is preferable that the inner diameter of the gas introduction hole is narrower than the inner diameter of the open portion.

It is preferable that the spray gun further includes a gas introduction portion which is formed at the nozzle section and leads the gas fed from the outside, to the gas introduction hole, wherein the inner diameter of the gas introduction portion is larger than the inner diameter of the gas introduction hole.

The gas introduction hole may also be formed to be inclined toward the leading end direction toward the inside of the nozzle section.

In the present invention, it is preferable that the raw material liquid is a mixed liquid of a plurality of mixture-cure type liquid agents, and the liquid agents are mixed in the main body section to produce the raw material liquid.

A spray application apparatus according to the present invention includes the above-described spray gun; a liquid agent supply section which supplies the raw material liquid; and a gas supply section which supplies gas to the spray gun.

A spray application method according to the present invention is a spray application method which performs spray application with the above-described spray gun, including the steps of: spouting out the raw material liquid in a fine particle form into the open portion by introducing the raw material liquid into the open portion through an introduction path of the nozzle section and also introducing the gas from an gas introduction hole into a base-end-side portion of the open portion; re-aggregating the raw material liquid containing the gas in the reduced diameter portion; and ejecting the raw material liquid together with the gas from the ejection orifice portion to the outside in order to form the resin layer on an application object.

Effects of the Invention

According to the present invention, the spray gun is provided with the nozzle section having the open portion in which a flow path is enlarged more than the introduction path. The gas introduction hole which introduces gas into the base-end-side portion of the open portion is formed in the nozzle section. The gas is supplied into the open portion in which discharge pressure is lowered.

Since discharge pressure is lowered in the open portion, the raw material liquid hardly flows (flows back) into the gas introduction hole, even if transport pressure of the raw material liquid is set to be high.

Since the transport pressure of the raw material liquid can be set to be high, a supply amount of the raw material liquid can be increased, making the time required for application shorter.

Also, since the backflow of the raw material liquid to the gas introduction hole hardly occurs, a supply pressure of gas can be set to be low. Therefore, excessive scattering of the raw material liquid at the time of the spray application is reduced, suppressing placement of resin onto unintended locations. At the same time, a low-density resin layer with low in surface roughness can be formed.

In the spray gun, the liquid agents are uniformly mixed with each other and uniformly dispersed in the gas, since the gas is supplied into the open portion, and the raw material liquid is turned into fine particles.

Further, the raw material liquid turned into fine particles re-aggregates in a state where a large amount of gas is uniformly infused therein, in the reduced diameter portion.

In this manner, since the raw material liquid undergoes the process of being turned into fine particles and then re-aggregated in a state where a sufficient amount of gas is infused therein, the raw material liquid is sufficiently mixed and also lowered in density.

Also, since the raw material liquid is sufficiently mixed, the physical properties (elongation and the like) of the resin layer are improved. Further, since softness is improved due to the improvement in physical properties (elongation and the like) and the density is lowered, a low-density resin layer that has superb capability to follow and buffer the movement of the substrate can be obtained.

The low-density resin layer obtained by the present invention has a function as a substrate layer such as correcting concavity/convexity of a substrate and also suppressing the generation of pinholes, and a function as a substrate-behavior buffer layer which buffers the behavior (movement) of the substrate.

Also, since a low-density resin layer can be formed, the weight of the resin layer is reduced.

Also, since the raw material liquid is mixed uniformly in the spray gun of the present invention, it is not necessary to provide an agitation device in the nozzle section.

Therefore, when the discharge of the raw material liquid is stopped, it is only required to discharge the raw material liquid from the nozzle section by air or the like, to suppress fixation of resin in the nozzle section. Accordingly, solvent cleaning is not necessarily required, so that ease of application can be increased. Also, the fixation of resin in the nozzle section can be further suppressed by coating the inner surface of the nozzle section by a resin (Teflon (registered trademark) or the like).

Also, since an agitation device is not required, the component parts of the nozzle section can be reduced, so that an internal structure can be simplified. Accordingly, maintenance is also easy.

Also, by forming the gas introduction hole such that the inner diameter thereof is smaller than those of the open portion and the gas introduction portion, the back-flow of the raw material liquid hardly occurs.

BEST MODE FOR CARRYING OUT THE INVENTION

A spray gun 1 which is one embodiment of the spray gun according to the present invention will be described.

Figure 1:
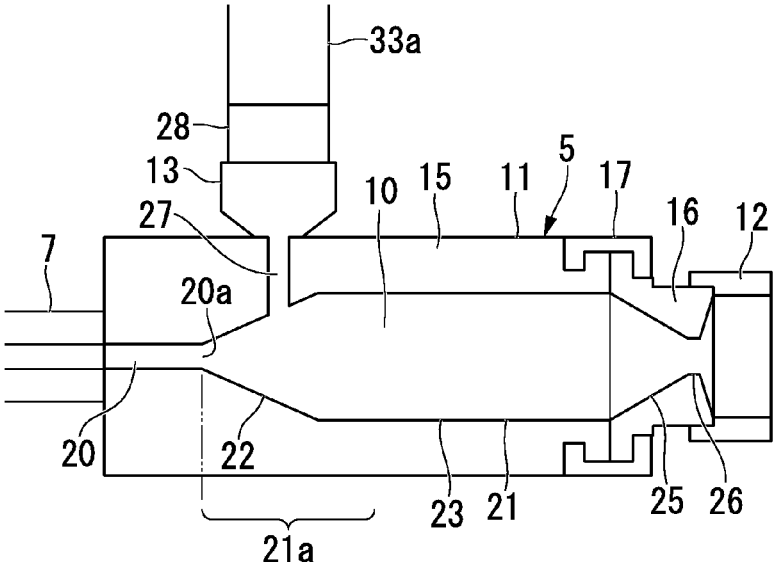
FIG. 1 is a schematic diagram showing the internal structure of a nozzle section of one example of a spray gun according to the present invention.
Figure 2:
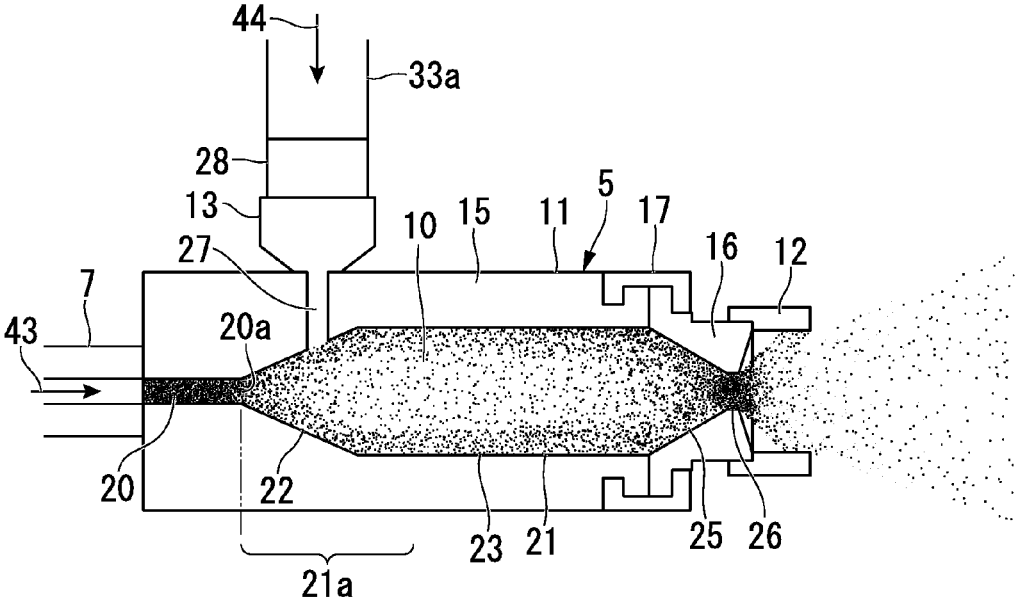
FIG. 2 is an explanatory diagram showing the nozzle section in action.
Figure 3:
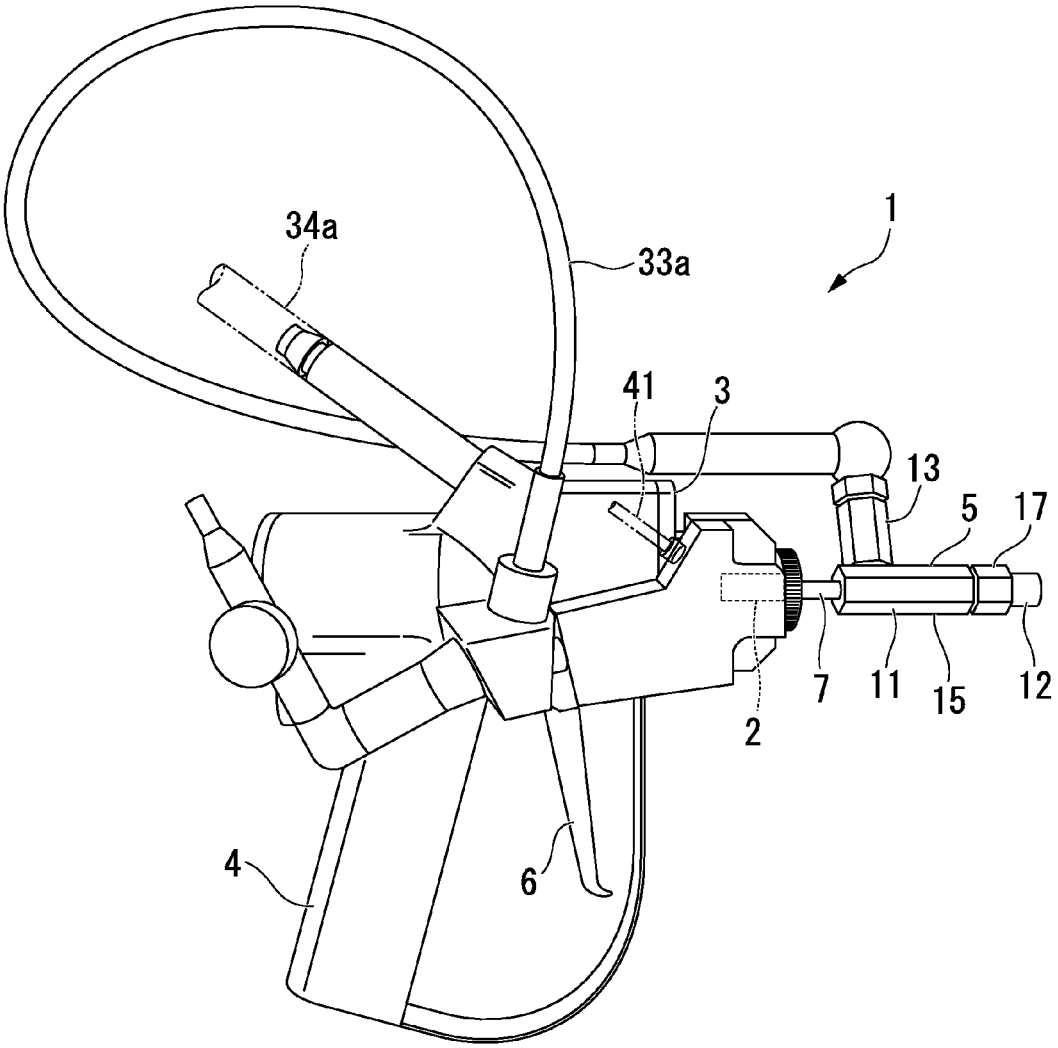
FIG. 3 is a front view showing the spray gun.
Figure 4:
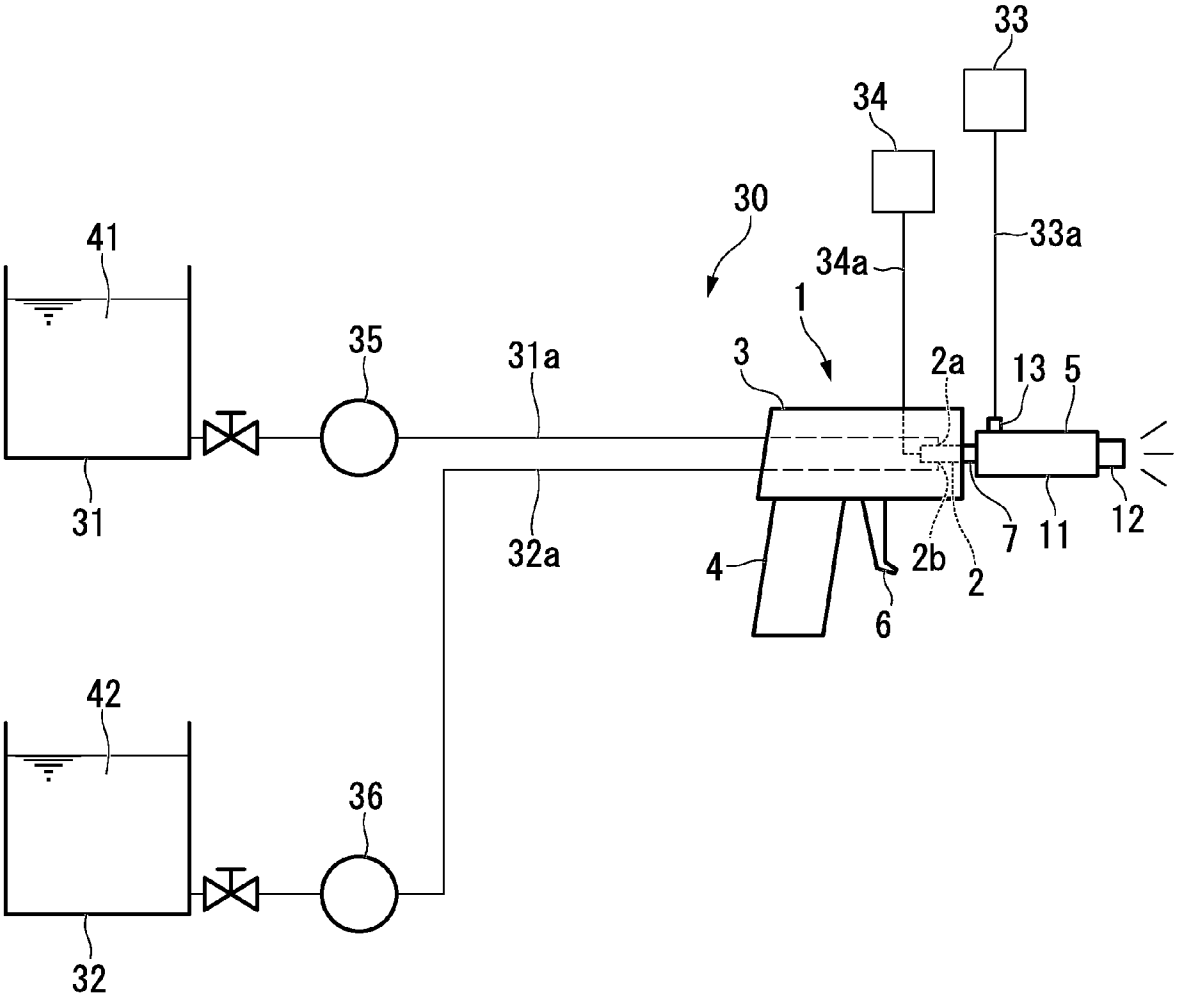
FIG. 4 is a schematic diagram showing a spray application apparatus provided with the spray gun.

FIG. 1 is a schematic diagram showing the internal structure of a nozzle section 5 of the spray gun 1. FIG. 2 is an explanatory diagram showing the nozzle section 5 in action. FIG. 3 is a front view showing the spray gun 1. FIG. 4 is a schematic diagram showing a spray application apparatus 30 provided with the spray gun 1.

As shown in FIG. 4, the spray application apparatus 30 is provided with a first liquid agent tank 31 (a first liquid agent supply section), a second liquid agent tank 32 (a second liquid agent supply section), the spray gun 1 which mixes liquid agents 41 and 42 from these tanks and ejects the mixture toward an application object (not shown), a gas supply section 33 which supplies gas to the spray gun 1, and a driving air supply section 34. The driving air supply section 34 may also serve as the gas supply section 33 at the same time. Reference numbers 35 and 36 denote liquid feed pumps.

The first liquid agent tank 31 and the second liquid agent tank 32 supply the first liquid agent 41 and the second liquid agent 42, respectively. The first liquid agent 41 and the second liquid agent 42 are materials which generate resin (mixture-cure type resin) (for example, polyurethane or polyurea) which is cured by mixing.

The gas supply section 33 is provided in order to obtain resin which is lower in density by making gas be contained in the above-mentioned resin. It can be an air compressor, a gas cylinder, or the like, for example, and supplies air, carbon dioxide, nitrogen, or the like as the gas.

The driving air supply section 34 supplies driving air for driving a mixing portion 2 of a main body section 3 through a pipe line 34*a*. As the driving air supply section 34, for example, an air compressor or the like can be used.

As shown in FIGS. 3 and 4, the spray gun 1 is provided with the main body section 3 having the mixing portion 2 which makes the first liquid agent 41 and the second liquid agent 42 mix with each other, a gripping portion 4 which is gripped by a worker, and the nozzle section 5 which is provided at the leading end of the main body section 3, thereby mixing gas into the mixed liquid (raw material liquid) and also ejecting the mixed liquid.

Hereinafter, a leading end direction of the nozzle section 5 is sometimes referred to as the front and the opposite direction is sometimes referred to as the rear (a base end direction). Also, the front-back direction is sometimes referred to as a length direction.

The first liquid agent 41 led from the first liquid agent tank 31 by a pipe line 31*a*, and the second liquid agent 42 conducted from the second liquid agent tank 32 by a pipe line 32*a*, are mixed at the mixing portion 2 of the main body section 3.

The mixing portion 2 has first and second liquid agent introduction holes 2*a* and 2*b* on one side and the other side, respectively, for example. It can be formed into the form of a container which is movable back and forth by the pressure of the driving air.

The mixing portion 2 can be made into a structure in which when a lever 6 is pressed into a direction coming close to the gripping portion 4, the mixing portion 2 is moved backward, so that the introduction holes 2*a* and 2*b* are opened. As a result, the liquid agents 41 and 42 are introduced into an internal space of the mixing portion 2, thereby being mixed with each other, and the mixed liquid is led to the nozzle section 5 through a pipe line 7.

The mixing portion 2 can be made into a structure in which when the lever 6 is released to a direction moving away from the gripping portion 4, the mixing portion 2 is moved forward, so that the introduction holes 2*a* and 2*b* are closed. As a result, the supply of the liquid agents 41 and 42 is stopped, and also the driving air is introduced into the inside, so that the mixed liquid in the mixing portion 2 and the nozzle section 5 is discharged to the outside.

As shown in FIGS. 1 and 2, the nozzle section 5 is provided with a nozzle section main body 11, which is in a tubular shape and has an internal space 10, and a leading end tube portion 12 provided at the leading end of the nozzle section main body 11.

The nozzle section main body 11 has a base body portion 15 and a leading end attachment portion 16 which is mounted on the leading end of the base body portion 15.

Reference numeral 17 denotes a cap portion for mounting the leading end attachment portion 16 on the base body portion 15.

The base body portion 15 is made into a structure in which the base body portion has an introduction path 20 which is communicated with the pipe line 7, and an open portion 21 which is a space that is communicated with the introduction path 20, so that mixed liquid 43 introduced from the pipe line 7 through the introduction path 20 can be introduced into the open portion 21.

The open portion 21 is formed such that the cross-sectional area of a flow path is larger than that of the introduction path 20. In other words, the open portion 21 has a flow path which is enlarged compared to the introduction path 20.

The open portion 21 of the illustrated example has an enlarged diameter portion 22 in which the inner diameter thereof is gradually enlarged toward a leading end direction (the right side in FIG. 1) and a constant-diameter portion 23 having a constant (or approximately constant) inner diameter and formed on the leading end side of the enlarged diameter portion.

The minimum inner diameter of the enlarged diameter portion 22 may be approximately equal to the inner diameter of the introduction path 20, and the inner diameter of the constant-diameter portion 23 may be approximately equal to the maximum inner diameter of the enlarged diameter portion 22. In the enlarged diameter portion 22 of the illustrated example, the inner diameter is enlarged at a constant angle.

In addition, the shape of the open portion 21 is not limited to the illustrated example. The inner diameter of the open portion 21 may also be constant (or approximately constant) over the entire length.

An internal space of the leading end attachment portion 16 has a reduced diameter portion 25 in which the inner diameter thereof is gradually reduced toward the leading end direction, and an ejection orifice portion 26 formed on the leading end side thereof.

In the reduced diameter portion 25, the cross-sectional area of a flow path becomes smaller than that of the constant-diameter portion 23. In other words, the flow path is reduced.

The reduced diameter portion 25 of the illustrated example is made such that the maximum inner diameter thereof is approximately equal to the inner diameter of the constant-diameter portion 23. The inner diameter of the reduced diameter portion 25 is reduced at a constant angle toward the leading end direction.

The inner diameter of the ejection orifice portion 26 can be made to be approximately equal to the minimum inner diameter of the reduced diameter portion 25.

In addition, although the reduced diameter portion 25 of the illustrated example has the inner diameter which is gradually reduced toward the leading end direction, the shape of the reduced diameter portion is not limited to this, but the inner surface thereof may also be vertical to the leading end direction.

Taken together, the internal space 10 of the nozzle section 5 has a structure including the introduction path 20, the open portion 21 located on the leading end side of the introduction path and having the flow path enlarged more than the introduction path 20, the reduced diameter portion 25 located on the leading end side of the open portion and having the reduced flow path, and the ejection orifice portion 26 located on the leading end side of the reduced diameter portion.

The leading end tube portion 12 is a tubular body which is provided in order to suppress scattering of the mixed liquid 43 and has an inner diameter larger than the inner diameter of the ejection orifice portion 26. It is formed to further extend toward the leading end direction than the leading end of the nozzle section main body 11.

Although, the cross-sectional shape of the leading end tube portion 12 is not particularly limited, it is preferable to be an approximately circular shape. According to this, an ejected shape of the mixed liquid 43 becomes an approximately circular shape, so that a resin layer having a constant thickness is easily formed.

In the base body portion 15 of the nozzle section main body 11, a gas introduction hole 27 which introduces gas 44 into the internal space 10 is formed.

At the nozzle section main body 11, a gas introduction portion 13 is formed which leads the gas 44 fed from the outside gas supply section 33 through a pipe line 33*a* to the gas introduction hole 27.

The gas introduction hole 27 is formed to be able to introduce gas into a base-end-side portion 21*a* of the open portion 21.

The base-end-side portion 21*a* refers to an outlet 20*a* of the introduction path 20 which is a base end portion of the open portion 21, and the vicinity thereof. For example, the base-end-side portion 21 is a portion which extends from the base end portion (the outlet 20*a*) of the open portion 21 to the central position in the length direction (the front-back direction) of the open portion 21.

In the illustrated example, the gas introduction hole 27 is formed to be approximately vertical to the front-back direction. The gas introduction hole 27 has an opening at the enlarged diameter portion 22. Alternatively, the gas introduction hole 27 may also be formed to have an opening at the constant-diameter portion 23.

The gas introduction hole 27 is made to function as an orifice having an inner diameter smaller than those of the open portion 21 and the gas introduction portion 13. Thereby, the back-flow of the mixed liquid 43 hardly occurs.

For the gas introduction hole 27 to function as an orifice, it is preferable to have an inner diameter of the gas introduction hole 27 smaller than the inner diameters of the open portion 21 and the gas introduction portion 13. According to this, reduction of pressure of the gas 44 can be suppressed.

Since the gas 44 is introduced into the internal space 10 through the gas introduction hole 27, the pressure in the pipe line 33*a* is maintained at a predetermined pressure, so that the back-flow of the mixed liquid 43 hardly occurs.

Also, a check valve 28 is provided at the gas introduction portion 13, so that the back-flow of the mixed liquid 43 can be more reliably prevented.

Next, an operation of the spray gun 1 will be explained.

As shown in FIG. 4, the first liquid agent 41 and the second liquid agent 42 are materials which generate mixture-cure type resin such as polyurethane or polyurea. One of the liquid agents is a main agent containing an isocyanate component, and another one is a curing agent containing polyol, for example.

In the case of applying polyurethane resin, an isocyanate component (MDI or the like) may also be included as a main agent. As a curing agent, polyol (polyether polyol or the like) may also be included. The isocyanate component of the main agent may also be pre-polymerized by a reaction with polyol. The curing agent may also contain an amine compound such as DETDA, and water.

In the case of applying polyurea resin, a main agent including an isocyanate component and a curing agent including an amine compound can be used.

Although two-agent mixture-cure type resin is illustrated here, resin which is cured by mixing three or more agents can also be used.

The first liquid agent 41 led from the first liquid agent tank 31 through the pipe line 31*a* and the second liquid agent 42 led from the second liquid agent tank 32 through the pipe line 32*a* are introduced into the mixing portion 2 of the spray gun 1.

The liquid agents 41 and 42 are sent into the mixing portion 2 at a predetermined pressure by the liquid feed pumps 35 and 36, thereby being mixed to some extent, and the mixed liquid 43 flows into the nozzle section 5 through the pipe line 7.

As shown in FIGS. 1 and 2, the mixed liquid 43 flows into the open portion 21 from the mixing portion 2 through the pipe line 7 and the introduction path 20.

Since the open portion 21 has a larger cross-sectional area of the flow path than that of the introduction path 20, the internal pressure thereof becomes lower compared to the introduction path 20.

Along with the introduction of the mixed liquid 43, gas such as air is introduced into the open portion 21 from the pipe line 33*a* through the gas introduction hole 27 by the gas supply section 33.

The mixed liquid 43 is spouted into the open portion 21 while being dispersed in a fine particle form (as a mist) by the gas 44 and heads toward the leading end direction in the open portion 21 with the gas 44.

The gas introduction hole 27 is formed at the base-end-side portion 21*a* of the open portion 21, and gas is introduced into the internal space 10 which is under a relatively low pressure condition.

Therefore, the back-flow of the mixed liquid 43 from the internal space 10 to the gas introduction hole 27 hardly occurs.

Since the mixed liquid 43 is in a fine particle form (a mist), in the process of moving in the open portion 21, the liquid agents 41 and 42 are uniformly mixed with each other and uniformly dispersed within the gas 44.

When the mixed liquid reaches the reduced diameter portion 25, due to the reduced (narrowed) flow path, the mixed liquid 43 in a fine particle form re-aggregates in a state where a large amount of gas 44 is uniformly contained therein. Due to the re-aggregation, the mixed liquid 43 is infused with a large amount of gas, thereby density of the mixed liquid 43 is lowered.

The mixed liquid 43 infused with gas is ejected from the ejection orifice portion 26 with an expanded diameter toward the outside.

The mixed liquid 43 ejected in a direction excessively expanded, is deflected by the leading end tube portion 12, and the direction is changed. Therefore, the mixed liquid 43 is sprayed on an application object (not shown) without being excessively diffused, thereby forming a resin layer made of low-density resin.

Since the mixed liquid 43 undergoes the process of being turned into fine particles and then re-aggregating in a state where a sufficient amount of gas is infused therein, reaction efficiency at the time of mixture is improved, and also density is lowered. As a result, a low-density resin layer, having superb characteristics in terms of properties to follow and buffer the substrate movement, with excellent physical property, such as elongation, can be obtained.

Figure 5:
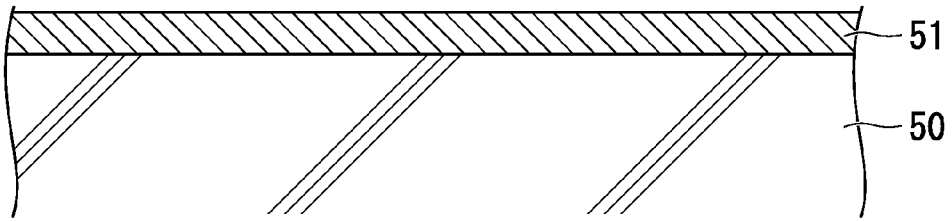
FIG. 5 is a schematic diagram showing one example of a resin layer formed by the present invention.

FIG. 5 shows an example of a resin layer formed by using the spray gun 1. A resin layer 51 has a single-layer structure and is formed on a substrate 50 (an application object) made of concrete, metal, or the like.

Figure 6:
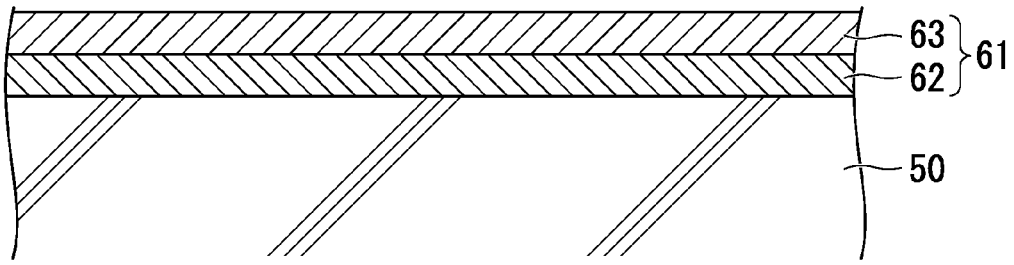
FIG. 6 is a schematic diagram showing another example of a resin layer formed by the present invention.

FIG. 6 shows another example of a resin layer formed by using the spray gun 1. A resin layer 61 has a multilayered structure composed of a lower layer 62 formed on the substrate 50, and an upper layer 63 formed thereon.

The lower layer 62 of the resin layer 61 is formed using a material softer than the upper layer 63, thereby being able to function as a substrate layer which corrects concavity/convexity of the substrate 50 and also suppresses the generation of pinholes, or a substrate-behavior buffer layer which buffers the behavior (movement) of the substrate 50.

In the resin layer 61, since high softness (in particular, elongation) is required for the lower layer 62, it is preferable to use the spray gun 1 at least in the formation of the lower layer 62. It is also possible to use the spray gun 1 in the formation of the upper layer 63. In addition, the resin layer may also have a structure composed of three or more layers.

In the case of forming a resin layer of a multilayered structure, it is preferable that at least the lower layer 62 be formed by using the spray gun 1.

In addition, on the surface of the substrate 50, an adhesion layer or a sheet such as a primer, which improves an adhesive force, may be appropriately provided. Also, on the surfaces of the resin layers 51 and 61, if it is needed, a protection layer such as protective paint or FRP may also be provided.

In the spray gun 1, the spray gun is provided with the nozzle section 5 having the open portion 21 in which the flow path is enlarged more than the introduction path 20. In the nozzle section 5, the gas introduction hole 27 which introduces gas into the base-end-side portion 21*a* of the open portion 21 is formed. The gas 44 is supplied to the open portion 21 with lowered discharge pressure.

Therefore, even if transport pressure of the mixed liquid 43 is set to be higher, the mixed liquid 43 hardly flows (flows back) into the gas introduction hole 27, since discharge pressure of the mixed liquid 43 is lowered in the open portion 21.

Since a transport pressure of the mixed liquid 43 can be set to be higher, a supply amount of the mixed liquid 43 can be increased, so that the time required for application can be shortened.

Also, since the back-flow of the mixed liquid 43 to the gas introduction hole 27 hardly occurs, supply pressure of the gas 44 can be set to be lower. Therefore, excessive scattering of the mixed liquid 43 at the time of the spray application hardly occurs. Therefore, placement of resin at unintended locations can be prevented, and furthermore a resin layer which is low in surface asperity can be formed.

In the spray gun 1, since the gas 44 is supplied into the open portion 21, so that the mixed liquid 43 is turned into fine particles, the liquid agents 41 and 42 are uniformly mixed with each other and uniformly dispersed in the gas 44.

Further, the mixed liquid 43 turned into fine particles re-aggregates in a state where a large amount of gas 44 is uniformly infused therein, in the reduced diameter portion 25.

In this manner, the mixed liquid 43 undergoes the process of being turned into fine particles and then re-aggregating in a state where the gas 44 is contained therein. As a result, reaction efficiency at mixing process is improved and density of the mixed liquid 43 is lowered at the same time. Due to the higher reaction efficiency of the mixed liquid, the physical properties (elongation and the like) of the resin layer are improved. Further, because of higher softness due to the improved physical properties (elongation and the like) and lowered density, a low-density resin layer which is excellent in characteristics such as a substrate following property and a buffering property to movement of the substrate can be obtained.

Also, since the mixed liquid 43 is mixed uniformly, it is not necessary to provide an agitation device in the nozzle section 5.

Therefore, when the discharge of the mixed liquid 43 is stopped, it is only required to discharge the mixed liquid 43 from the mixing portion 2 and the nozzle section 5 by using the driving air or the like, to suppress fixing of resin in the nozzle section. Accordingly, solvent cleaning is not necessarily required, so that ease of application can be increased. Also, the fixation of resin in the nozzle section can be suppressed further by coating the inner surface of the nozzle section by a resin (Teflon (registered trademark) or the like).

Also, since an agitation device is not required, the component parts of the nozzle section 5 can be reduced, so that an internal structure can be simplified. Accordingly, maintenance is also easy.

Figure 7:
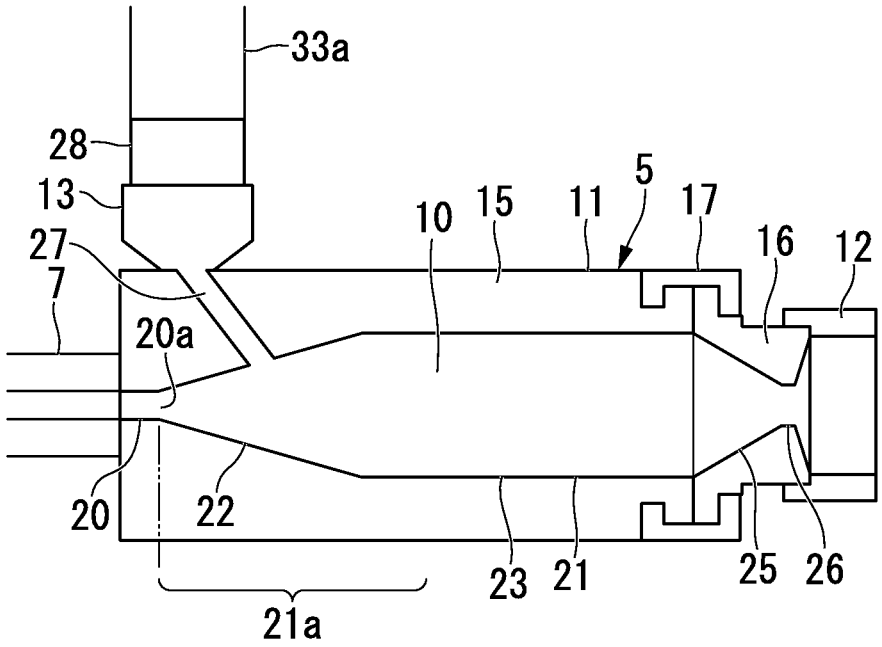
FIG. 7 is a schematic diagram showing the internal structure of a nozzle section of another example of the spray gun according to the present invention.

FIG. 7 shows another example of the nozzle section. In this example, the gas introduction hole 27 is formed to be inclined forward (in the leading end direction) toward the inside of the nozzle section main body 11.

By this configuration, since the introduction direction of the gas 44 includes the vector identical to the introduction direction of the mixed liquid 43, it becomes more difficult for the back-flow of the mixed liquid 43 to the gas introduction hole 27 to occur.

In addition, in the present invention, the resin is not limited to the mixture-cure type resin, but the moisture-cure type resin may also be used. In the case of using the moisture-cure type resin, the low-density resin layer is formed by introducing the raw material liquid into the nozzle section 5 through the mixing portion 2, mixing the gas into the material, and then spraying the mixture to an application object.

EXAMPLES

Examples 1 to 4

A resin layer made of polyurethane was formed on a substrate made of a plastic plate by using the spray application apparatus 30 provided with the spray gun 1 shown in FIGS. 1 to 4.

As the first liquid agent 41, a main agent containing an isocyanate group-terminated prepolymer composed of MDI and polyether polyol was used, and as the second liquid agent 42, a polyol-based curing agent containing DETDA (diethyl toluene diamine) was used.

As the gas 44, air was used.

The measured results of the physical properties of the resin layer are shown in Table 1. A measuring method of each physical property was based on JIS A6021.

The following method was adopted for evaluation of thermal insulation performance.

An opening of a box body made of foamed polystyrene was closed by using a resin sheet manufactured by using the spray application apparatus 30 provided with the spray gun 1. Then, infrared rays were illuminated to the resin sheet by using an infrared lamp installed outside the box body. Then, temperatures of the inner surface and the outer surface of the resin sheet were measured, and the difference between the temperatures was defined as "thermal insulation performance."

Example 5

A resin layer was formed by using carbon dioxide ($CO_2$) in stead of air as the gas 44. The other test conditions were based on Examples 1 to 4.

The measured results of the physical properties of the resin layer are shown in Table 1.

Comparative Example 1

A resin layer made of polyurethane was formed by using a spray gun of the prior art, in which an agitation device is built in a nozzle section, in stead of the spray gun 1. The other test conditions were based on Examples 1 to 4.

As the gas, carbon dioxide was used.

The measured results of the physical properties of the resin layer are shown in Table 1.

Comparative Example 2

A resin layer made of polyurethane was formed by using a spray gun of the prior art having no gas introduction structure, in stead of the spray gun 1. The other test conditions were based on Examples 1 to 4.

The measured results of the physical properties of the resin layer are shown in Table 1.

TABLE 1

| | Example 1 | Example 2 | Example 3 | Example 4 | Example 5 | Comparative Example 1 | Comparative Example 2 |
|---|---|---|---|---|---|---|---|
| Gas | air | air | air | air | $CO_2$ | $CO_2$ | no |
| Resin | poly-urethane | poly-urethane | poly-urethane | poly-urethane | poly-urethane | poly-urethane | poly-urethane |
| Thickness (mm) | 2.0 | 2.0 | 2.0 | 2.0 | 2.0 | 2.0 | 2.0 |
| Density (g/mL) | 0.83 | 0.66 | 0.5 | 0.35 | 0.5 | 0.35 | 1.0 |
| Tensile strength ($N/mm^2$) | 10.4 | 7.2 | 5.2 | 4.2 | 4.9 | 2.7 | 10.8 |
| Elongation (%) | 660 | 640 | 600 | 504 | 540 | 407 | 488 |
| Tensile product (N/mm) | 1374 | 919 | 619 | 419 | 533 | 223 | 1059 |
| Tear strength (N/mm) | 43.4 | 34.6 | 27.2 | 21.1 | 23.8 | 14.6 | 58.0 |
| Pattern diameter (cm) | 30 to 15 | 30 to 15 | 20 to 15 | 20 to 15 | 20 to 15 | 20 | 27.0 |
| Scattering | small | small | small | small | small | large | small |
| Finishing | smooth | smooth | smooth | smooth | smooth | convexity/ concavity | smooth |
| Thermal insulation performance (° C.) | not tested | not tested | 10 | not tested | not tested | not teseted | 4 |

Examples 6 and 7

A resin layer made of polyurea was formed by using the spray application apparatus 30 provided with the spray gun 1 shown in FIGS. 1 to 4.

As the first liquid agent 41, a main agent containing an isocyanate component was used, and as the second liquid agent 42, a curing agent containing an amine compound was used.

As the gas 44, air was used. The other test conditions were based on Examples 1 to 4.

The measured results of the physical properties of the resin layer are shown in Table 2.

Comparative Example 3

A resin layer made of polyurea was formed using a spray gun of the prior art having no gas introduction structure, in stead of the spray gun 1. The other test conditions were based on Examples 1 to 4.

The measured results of the physical properties of the resin layer are shown in Table 2.

TABLE 2

| | Example 6 | Example 7 | Comparative Example 3 |
|---|---|---|---|
| Gas | air | air | no |
| Resin | polyurea | polyurea | polyurea |
| Thickness (mm) | 2.0 | 2.0 | 2.0 |
| Density (g/mL) | 0.66 | 0.5 | 1 |
| Tensile strength ($N/mm^2$) | 19.7 | 14.1 | 22.7 |

TABLE 2-continued

| | Example 6 | Example 7 | Comparative Example 3 |
|---|---|---|---|
| Elongation (%) | 385 | 385 | 365 |
| Tensile product (N/mm) | 1518 | 1088 | 1656 |
| Tear strength (N/mm) | 74.1 | 54.5 | 90.3 |
| Pattern diameter (cm) | 30 to 15 | 20 to 15 | 27.0 |
| Scattering | small | small | small |
| Finishing | smooth | smooth | smooth |
| Thermal insulation performance (° C.) | not tested | not tested | not tested |

From Tables 1 and 2, it was found that a resin layer with higher elongation and lesser concavity/convexity could be formed by the use of the spray gun 1 of the present invention. Also, it was confirmed that excessive scattering of resin hardly occurred when the spray gun 1 of the present invention was used.

Also, from the comparison of Example 3 with Comparative Example 2 in Table 1, it was found that in Example 3, the thermal insulation performance was improved due to the lowering of the density of the resin layer.

INDUSTRIAL APPLICABILITY

The present invention can be applied to formation of a resin layer for the waterproof application of a rooftop, a veranda, a corridor, a floor, a wall, a ceiling, or the like of an architectural construction, or the covering application of a structure (play equipment or the like) in which an impact buffering function is required.

BRIEF DESCRIPTION OF THE REFERENCE SYMBOLS

1: SPRAY GUN
3: MAIN BODY SECTION
5: NOZZLE SECTION
10: INTERNAL SPACE
11: NOZZLE SECTION MAIN BODY
12: LEADING END TUBE PORTION
20: INTRODUCTION PATH
21: OPEN PORTION
21A: BASE-END-SIDE PORTION
22: ENLARGED DIAMETER PORTION
25: REDUCED DIAMETER PORTION
26: EJECTION ORIFICE PORTION
27: GAS INTRODUCTION HOLE
31: FIRST LIQUID AGENT TANK (FIRST LIQUID AGENT SUPPLY SECTION)
32: SECOND LIQUID AGENT TANK (SECOND LIQUID AGENT SUPPLY SECTION)
33: GAS SUPPLY SECTION
41: FIRST LIQUID AGENT
42: SECOND LIQUID AGENT
43: MIXED LIQUID
44: GAS
50: SUBSTRATE (APPLICATION OBJECT)
51, 61: RESIN LAYER

The invention claimed is:

1. A spray gun for forming a resin layer made of low-density resin by spraying raw material liquid along with gas, comprising:

a main body section into which the raw material liquid is introduced; and a nozzle section provided at a leading end of the main body section for mixing gas into the raw material liquid and ejecting the raw material liquid, wherein an internal space of the nozzle section includes an introduction path into which the raw material liquid is introduced, an open portion in which a flow path is enlarged more than the introduction path for spouting the raw material liquid in a fine particle form, a reduced diameter portion in which a flow path is made narrower than the open portion for re-aggregating the raw material liquid in a fine particle form, and an ejection orifice portion which ejects the raw material liquid to the outside, and wherein the open portion has an enlarged diameter portion in which the diameter thereof is gradually enlarged toward a leading end direction from an outlet of the introduction path, a gas introduction hole which has an opening at the enlarged diameter portion and introduces the gas into the enlarged diameter portion, and a gas introduction portion which leads the gas fed from the outside to the gas introduction hole are formed in the nozzle section, the inner diameter of the gas introduction hole is narrower than the inner diameter of the open portion, the inner diameter of the gas introduction portion is larger than the inner diameter of the gas introduction hole, and the gas introduction hole is inclined toward the leading end direction toward the inside of the nozzle section.

2. The spray gun according to claim 1, wherein a diameter of the reduced diameter portion is gradually reduced toward the leading end direction from the open portion.

3. The spray gun according to claim 1, wherein the nozzle section is further comprising: a main body having the internal space, and a leading end tube portion positioned at the leading end of the nozzle section main body, wherein an inner diameter of the leading end tube portion is larger than the inner diameter of the ejection orifice portion, and the leading end tube portion is further extended toward the leading end direction than the leading end of the nozzle section main body.

4. The spray gun according to claim 1, wherein the raw material liquid is a mixed liquid of a plurality of mixture-cure type liquid agents, and the liquid agents are mixed in the main body section to produce the raw material liquid.

5. A spray application apparatus comprising:

the spray gun according to claim 1;

a liquid agent supply section which supplies the raw material liquid; and a gas supply section which supplies gas to the spray gun.

6. A spray application method which performs spray application with the spray gun according to claim 1, comprising the steps of:

spouting out the raw material liquid in a fine particle form into the open portion by introducing the raw material liquid into the open portion through an introduction path of the nozzle section and also introducing the gas from a gas introduction hole into the enlarged diameter portion;

re-aggregating the raw material liquid containing the gas in the reduced diameter portion; and ejecting the raw material liquid together with the gas from the ejection orifice portion to the outside in order to form the resin layer on an application object.

* * * * *